US008357479B2

(12) United States Patent
Ariyoshi et al.

(10) Patent No.: US 8,357,479 B2
(45) Date of Patent: Jan. 22, 2013

(54) TONER AND METHOD FOR MANUFACTURING THE SAME

(75) Inventors: Satoru Ariyoshi, Osaka (JP); Yasuhiro Shibai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 230 days.

(21) Appl. No.: 12/869,790

(22) Filed: Aug. 27, 2010

(65) Prior Publication Data

US 2011/0053075 A1 Mar. 3, 2011

(30) Foreign Application Priority Data

Aug. 31, 2009 (JP) ..... 2009-200137

(51) Int. Cl.
*G03G 9/08* (2006.01)

(52) U.S. Cl. ..... 430/108.4; 430/109.1; 430/109.2; 430/137.1

(58) Field of Classification Search ..... 430/108.4, 430/109.1, 109.2, 137.1
See application file for complete search history.

(56) References Cited

U.S. PATENT DOCUMENTS

2003/0198883 A1* 10/2003 Hiratsuka et al. ..... 430/109.3
2005/0048390 A1* 3/2005 Moribe et al. ..... 430/109.3

FOREIGN PATENT DOCUMENTS

JP 8-44107 2/1996
JP 9-281746 10/1997

* cited by examiner

*Primary Examiner* — Mark A Chapman
(74) *Attorney, Agent, or Firm* — Nixon & Vanderhye P.C.

(57) ABSTRACT

A toner comprising: a component consisting of a thermoplastic resin containing an amorphous plant-derived resin having a carboxyl group; a component consisting of a crystalline epoxy resin having a glycidyl group; a component consisting of a cross-linked resin generated through a reaction between the carboxyl group of the plant-derived resin and the glycidyl group of the crystalline epoxy resin; and a colorant.

26 Claims, No Drawings

TONER AND METHOD FOR MANUFACTURING THE SAME

CROSS-REFERENCE TO RELATED APPLICATION

This application is related to Japanese Patent Application No. 2009-200137 filed on 31 Aug., 2009, whose priority is claimed under 35 USC §119, and the disclosure of which is incorporated by reference in its entirety.

BACKGROUND OF THE INVENTION

1. Field of the Invention

The present invention relates to a toner needed for an electrophotographic technique and a method for manufacturing the toner.

More particularly, the present invention relates to a toner comprising: a component consisting of an amorphous plant-derived resin having a carboxyl group; a component consisting of a crystalline epoxy resin having a glycidyl group; and a component consisting of a cross-linked resin obtained by cross-linking the carboxyl group of the plant-derived resin and the glycidyl group of the epoxy resin, and to a method for manufacturing the toner.

2. Description of the Related Art

Generally, image forming apparatuses using an image formation process of an electrophotographic system form a desired image on a medium by carrying out a series of steps including: a charge step for uniformly charging a photosensitive layer on a surface of a photosensitive drum working as a latent image carrier; an exposure step for projecting signal light of an image on a document onto the surface of the photosensitive drum in a charged state to form an electrostatic latent image; a development step for developing the electrostatic latent image on the surface of the photosensitive drum by supplying an electrophotographic toner to the electrostatic latent image; a transfer step for transferring the toner image on the surface of the photosensitive drum onto a medium such as paper and an OHP sheet; a fixing step for fixing the toner image on the medium by heating and pressurization; and a cleaning step for cleaning the surface of the photosensitive drum by removing toner and the like left on the surface of the photosensitive drum after the transfer of the toner image with a cleaning blade.

In some cases, the transfer of the toner image to the medium is performed via an intermediate transfer medium. Developers used for such image forming apparatuses include a one-component developer consisting only of a toner as the main component and a two-component developer containing a mixture of a toner and a carrier for use.

The toners used for these developers are produced by, for example, a kneading and pulverizing method or a polymerization method represented by a suspension polymerization method and an emulsion polymerization aggregation method.

In the kneading and pulverizing method, toner materials containing a binder resin and a colorant as main components, and optionally containing a release agent, a charge controlling agent, and the like added and mixed therein are melted and kneaded, cooled and solidified, and then pulverized and classified to manufacture a toner.

From the viewpoint of global environment conservation, various efforts have been made in various technical areas in recent years. Since materials of a number of manufactured articles are currently produced from petroleum, efforts to reduce carbon dioxide generated and energies needed when such materials are produced or burnt are very important from the viewpoint of prevention of global warming.

In addition, while energy saving has been also considered from various angles as another effort leading to prevention of global warming, there is a growing awareness that reduction of fixing energy by lowering fixing temperature for a toner transferred on a medium such as paper and an OHP sheet is effective in the field of electrophotography.

At the same time, copying machines and facsimile machines are desired to be further high-speed. In order to deal with such trends, lowering of the melting temperature of toner is essential.

As a method for fixing a toner image transferred onto a medium such as paper and an OHP sheet, a contact heating type fixing method is often used in which the toner image is heated, melted, and pressurized by using a heat roll or the like to fix the image on the medium.

Toner can be evaluated for the fixing ability in the contact heating type fixing method by determining a temperature width allowing fixation between a fixing temperature of the lower limit and a temperature for hot offset initiation.

The above-mentioned lowering of the melting temperature of toner means lowering of the fixing temperature of the lower limit, whereby fixation at low temperature can be achieved.

As the binder resin for toner, a resin having a cross-linked structure, a resin containing a high molecular weight substance and a low molecular weight substance, and the like are used. In this regard, on one hand, when the content of a cross-link component or a high molecular weight substance component is increased to improve the hot offset resistance in such binder resins, the melt viscosity of the resin will be too large, which may cause insufficient low-temperature fixing ability of the toner.

On the other hand, when the content of a low molecular weight substance component is increased to improve the low-temperature fixing ability, the melt viscosity of the resin will be smaller, but the elasticity of the toner will be reduced, which may cause deterioration in hot offset resistance.

Accordingly, design of the binder resin for toner is particularly important to achieve the lowering of the melting temperature of toner and maintain the offset resistance at high temperature.

In addition, use of plant-derived resources called biomass attracts a lot of attention as a new effort leading to prevention of global warming.

This is because carbon dioxide generated when the biomass is burnt is originally carbon dioxide in the atmospheric air taken by plants through photosynthesis, and it is therefore considered that the balance of the carbon dioxide in the atmospheric air is zero in total, that is, the total amount of the carbon dioxide dose not change.

The property of thus not apparently affecting increase or decrease of carbon dioxide in the atmospheric air is referred to as carbon-neutral, and it is considered that use of carbon-neutral plant-derived resources can fix the content of carbon dioxide in the atmospheric air.

Plastics produced from such biomass are referred to as biomass polymers, biomass plastics, nonpetroleum-based polymeric materials or the like, and monomers that can be materials for these plastics are referred to as biomass monomers.

In the field of electrophotography, likewise, there has been made an effort of using biodegradable resins containing biomass as resources excellent in environmental safety and effective for carbon dioxide emission reduction in consideration for global environment conservation.

To take a polyester resin as an example, which is generally produced by condensation polymerization of a dicarboxylic acid component and a diol component, there have been proposed a technique in which a polyester resin produced by using a biomass monomer such as succinic acid and itaconic acid as the dicarboxylic acid component and using a biomass monomer such as 1,3-propanediol as the diol component is used as a binder resin for color toner; and a technique in which a polylactic resin, which is a biomass polymer produced from lactic acid as a material obtained from corn or other plants is used as a binder resin for toner.

However, these plant-derived resins are aliphatic hydrocarbon compounds and therefore, when used as a binder resin for toner, cause the toner to have poor hot offset resistance.

To deal with this problem, Japanese Unexamined Patent Publication No. HEI 9 (1997)-281746 proposes a method of improving the hot offset resistance of toner by cross-linking polylactic acid, which is a plant-derived resin by an isocyanato.

In the toner produced by the method disclosed in Japanese Unexamined Patent Publication No. HEI 9 (1997)-281746, however, the low-temperature fixing ability is reduced, while the hot offset resistance can be improved.

SUMMARY OF THE INVENTION

In view of the above-described problems, the present invention has been achieved to provide a toner that is conscious about global environment conservation, capable of maintaining the low-temperature fixing ability and excellent in hot offset resistance, and a method for manufacturing the toner.

The inventors of the present invention have made intensive studies and efforts and, as a result, found that the above-described problems could be solved by including a component consisting of an amorphous plant-derived resin having a carboxyl group; a component consisting of a crystalline epoxy resin having a glycidyl group; a component consisting of a cross-linked resin obtained by cross-linking the carboxyl group of the plant-derived resin and the glycidyl group of the epoxy resin in a binder resin; and a colorant in a toner to complete the present invention.

Thus, in accordance with an aspect of the present invention, there is provided a toner comprising: a component consisting of a thermoplastic resin containing an amorphous plant-derived resin having a carboxyl group; a component consisting of a crystalline epoxy resin having a glycidyl group; a component consisting of a cross-linked resin generated through a reaction between the carboxyl group of the plant-derived resin and the glycidyl group of the crystalline epoxy resin; and a colorant.

In accordance with another aspect of the present invention, there is provided a toner wherein the crystalline epoxy resin has a melting temperature of 90° C. to 130° C.

In accordance with still another aspect of the present invention, there is provided a method for manufacturing a toner, comprising melting and kneading a component consisting of an amorphous plant-derived resin having a carboxyl group and a component consisting of a crystalline epoxy resin having a glycidyl group at a maximum temperature of 130° C. or more to obtain a toner comprising: a component consisting of the plant-derived resin; a component consisting of the epoxy resin; a component consisting of a cross-linked resin generated through a reaction between the carboxyl group of the plant-derived resin and the glycidyl group of the crystalline epoxy resin; and a colorant.

The present invention provides a toner that is effective for prevention of global warming, because a plant-derived resin using plant-derived resources, which are carbon-neutral, is used as a binder resin. Besides, the toner can be excellent in hot offset resistance, while maintaining the low-temperature fixing ability as containing the crystalline epoxy resin component and the cross-linked resin component. Further, when an epoxy resin having a melting temperature of 90° C. to 130° C. is used as the crystalline epoxy resin, a toner having high fixing strength can be obtained.

More particularly, the present invention provides a toner that has excellent hot offset resistance while maintaining the low-temperature fixing ability, because the binder resin in the toner contains a component consisting of an amorphous plant-derived resin having a carboxyl group; a component consisting of a crystalline epoxy resin having a glycidyl group; and a component consisting of a cross-linked resin obtained by cross-linking the carboxyl group of the plant-derived resin and the glycidyl group of the epoxy resin.

DESCRIPTION OF THE PREFERRED EMBODIMENTS

Hereinafter, the present invention will be described in detail.

1. Toner

The toner of the present invention contains at least a binder resin and a colorant.

The binder resin contains an amorphous plant-derived resin having a carboxyl group; a crystalline epoxy resin having a glycidyl group; and a cross-linked resin having a cross-linked structure and generated through a reaction between the carboxyl group of the plant-derived resin and the glycidyl group of the epoxy resin.

(1) Amorphous Plant-Derived Resin Having Carboxyl Group

Examples of the amorphous plant-derived resin having a carboxyl group used for the present invention include an amorphous plant-derived resin having a carboxyl group as its functional group.

The plant-derived resin means a material containing, as its material, a compound having carbon atoms taken from carbon dioxide in the atmospheric air by a plant through photosynthesis as a backbone.

Even when the plant-derived resin is burnt and carbon dioxide is generated, therefore, the amount of carbon dioxide in the atmospheric air does not increase substantially; it is considered that the total amount of carbon dioxide in the atmospheric air does not change.

The toner containing a plant-derived resin can be therefore considered a toner capable of inhibiting environmental pollution.

As the plant-derived resin, a chemical synthetic resin obtained by chemically polymerizing plant-derived polymers or monomers may be used.

Examples of the chemical synthetic resin derived from plant-derived polymers or monomers include polylactic acid, polymethylene terephthalate, polybutylene succinate, polyhydroxybutyrate, polyhydroxyalkanoate, polyester resins composed of succinic acid or itaconic acid and 1,3-propanediol or 1,4-butanediol as monomers, and the like.

The proportion of the plant-derived resin in the amorphous resin is preferably 20% by weight or more. When the proportion of the plant-derived resin is less than 20% by weight, the content thereof is too small, producing a minimal effect on global environment conservation.

As the amorphous resin containing 20% by weight or more of the plant-derived resin, may be used a resin obtained by mixing a resin containing a plant-derived resin with a commonly known thermoplastic resin or a resin obtained by chemically polymerizing plant-derived polymers or monomers in production of a thermoplastic resin.

In the toner according to the present application, the carboxyl group in the plant-derived resin and the glycidyl group in the crystalline epoxy resin are reacted to form a cross-linked structure between the amorphous plant-derived resin and the crystalline epoxy resin.

Since the amorphous plant-derived resin having a carboxyl group and the crystalline epoxy resin having a glycidyl group form the cross-linked resin having a cross-linked structure in the toner, the toner of the present invention will contain a gel component to have high viscosity particularly at high temperature.

In addition, the toner of the present invention is improved in heat resistance and, as a result, will be able to inhibit occurrence of hot offset, raising the fixing temperature of the upper limit. Accordingly, it is possible to provide a toner having good low-temperature fixing ability and wide temperature width allowing fixation.

(Amorphous Polyester Resin)

For the plant-derived resin having a carboxyl group to be used for the present invention, a commonly known amorphous polyester resin may be added to an amorphous plant-derived resin having a carboxyl group.

The amorphous polyester resin can be obtained through polycondensation of a polybasic acid and a polyhydric alcohol, for example.

Examples of the polybasic acid include commonly known monomers for polyesters including aromatic carboxylic acids such as terephthalic acid, isophthalic acid, phthalic anhydride, trimellitic anhydride, pyromellitic acid and naphthalenedicarboxylic acid; aliphatic carboxylic acids such as maleic anhydride, fumaric acid, succinic acid, alkenyl succinic anhydride and adipic acid; and methyl esters of these polybasic acids.

The above-mentioned polybasic acids can be used independently or in combination of two or more kinds thereof.

Examples of the polyhydric alcohol include commonly known monomers for polyesters including aliphatic polydric alcohols such as ethyleneglycol, propylene glycol, butanediol, hexanediol, neopentylglycol and glycerin; alicyclic polyhydric alcohols such as cyclohexanediol, cyclohexanedimethanol and hydrogenated bisphenol A; and aromatic diols such as an ethylene oxide adduct of bisphenol A and a propylene oxide adduct of bisphenol A.

The above-mentioned polyhydric alcohols can be used independently or in combination of two or more kinds thereof.

The polycondensation reaction between the polybasic acid and the polyhydric alcohol may be carried out according to a conventional method. For example, the reaction is caused by contacting the polybasic acid with the polyhydric alcohol in the presence or absence of an organic solvent and in the presence of a polycondensation catalyst, and stopped when the acid value, the softening temperature, and the like of the polyester to generate reach predetermined values. Thus, an amorphous polyester resin is obtained.

When a methyl ester of a polybasic acid is used as a part of the polybasic acid, a demethanolation polycondensation reaction is performed. By appropriately varying the blending ratio, the rate of reaction, and the like of the polybasic acid and the polyhydric alcohol in this polycondensation reaction, for example, the content of the terminal carboxyl group of the polyester can be adjusted, and thereby properties of the amorphous polyester resin to be obtained can be varied.

In addition, when trimellitic anhydride is used as the polybasic acid, a carboxyl group can be readily introduced into the principal chain of the polyester.

Hereinafter, a method for producing a polyester-based binder that can be used for the toner of the present invention will be exemplified.

The polyester resin that can be used for the toner of the present invention can be obtained by mixing, heating and dehydration-condensing a carboxylic acid and an alcohol in a predetermined ratio in the presence of an esterification catalyst.

The reaction is usually carried out under a temperature condition of approximately 150° C. to 300° C., and preferably approximately 170° C. to 280° C. in the presence of the catalyst.

In addition, the reaction can be carried out under normal pressure, under reduced pressure or under increased pressure, which is desirably adjusted in the reaction system appropriately with monitoring progress of the reaction using physical properties (for example, acid value, melt flow rate, etc.) and the stirring torque or the power level of the reaction machine as indications.

The polyester resin of the present invention can be obtained by stopping the reaction when the physical properties reach predetermined levels.

The acid value of the amorphous polyester resin is preferably 10 KOHmg/g to 30 KOHmg/g, and more preferably 15 KOHmg/g to 25 KOHmg/g.

When the acid value of the amorphous polyester resin is less than 10 KOHmg/g, the amount of the carboxyl group in the amorphous polyester resin is so small that the cross-linking reaction between the amorphous polyester resin and the crystalline epoxy resin will be difficult to occur. This may lead to insufficient formation of the gel component in the toner and eventually insufficient toner viscosity, causing failure in stable prevention of hot offset.

On the other hand, when the acid value of the amorphous polyester resin is more than 30 KOHmg/g, the amount of water in the toner may increase to reduce environmental stability, because the carboxyl group in the amorphous polyester resin is easy to absorb water in the air.

Thus, when the acid value of the amorphous polyester resin is 10 KOHmg/g to 30 KOHmg/g, the cross-linking reaction between the amorphous polyester resin and the crystalline epoxy resin occurs moderately, allowing maintenance of good environmental stability and prevention of occurrence of hot offset.

The weight average molecular weight (Mw) of the amorphous polyester resin is preferably 5000 to 100000, and the number average molecular weight (Mn) of the amorphous polyester resin is preferably 1000 to 10000.

The glass transition temperature (Tg) of the amorphous polyester resin is preferably 55° C. to 70° C.

When the glass transition temperature (Tg) of the amorphous polyester resin is less than 55° C., blocking, which is heat-aggregation of toner, is likely to occur in an image forming apparatus, which may reduce storage stability.

On the other hand, when the glass transition temperature (Tg) of the amorphous polyester resin is more than 70° C., the fixing ability of the toner to a recording medium is reduced, which may cause insufficient fixation.

Further, the ½ flow softening temperature (Tm) of the amorphous polyester resin is preferably in a range of 100° C. to 140° C.

A toner having both the stable storage stability and fixing ability can be obtained by using the amorphous polyester resin in such a temperature range.

(2) Crystalline Epoxy Resin

The crystalline epoxy resin to be used for the toner of the present invention is a relatively low molecular polymer having two or more reactive epoxy groups (glycidyl groups) in one molecule and a crystalline resin obtained through polycondensation of the polymer.

A toner containing the crystalline epoxy resin can be fixed at low temperature. However, when the toner contains merely the crystalline epoxy resin, the storage stability of the toner will be poor, because a crystalline component of the crystalline epoxy resin melts to bleed on the surface of the toner when a developer is stored under a high temperature condition.

In this embodiment, the toner contains the crystalline epoxy resin to lower the fixing temperature of the lower limit and can be therefore fixed at low temperature.

Further, since the carboxyl group of the amorphous plant-derived resin and the glycidyl group of the crystalline epoxy resin form a cross-linked structure as described above, the crystalline component of the crystalline epoxy resin can be prevented from melting and bleeding on the surface of the toner under a high temperature condition.

Thus, the toner can be fixed at low temperature, while having good storage stability under a high temperature condition.

Though not particularly limited, examples of the crystalline epoxy resin to be used for the toner of the present invention include bisphenol-type, thioether-type, hydroquinone-type and biphenyl-type epoxy resins. Out of these epoxy resins, biphenyl-type epoxy resins are suitably used as having a relatively low melting temperature and a low epoxy equivalent.

The melting temperature of the crystalline epoxy resin is preferably 90° C. to 130° C., and more preferably 100° C. to 120° C.

When the melting temperature of the crystalline epoxy resin is less than 90° C., the storage stability under a high temperature condition may be reduced.

On the other hand, when the melting temperature of the crystalline epoxy resin is more than 130° C., the low-temperature fixing ability may not be ensured.

Thus, when the melting temperature of the crystalline epoxy resin is 90° C. to 130° C., it is possible to ensure stable low-temperature fixing ability, while improving storage stability under a high temperature condition.

The epoxy equivalent of the crystalline epoxy resin is preferably 100 to 300. When the epoxy equivalent of the crystalline epoxy resin is less than 100, the resin will be polyfunctional to have too many reaction points, making it difficult to control the gel component. As a result, the fixing temperature will be too high.

On the other hand, when the epoxy equivalent of the crystalline epoxy resin is more than 300, this may lead to insufficient formation of the gel component in the toner and eventually insufficient toner viscosity, causing failure in stable prevention of hot offset.

Thus, when the epoxy equivalent of the crystalline epoxy resin is 100 to 300, the cross-linking reaction between the amorphous plant-derived resin having a carboxyl group and the crystalline epoxy resin occurs moderately thereby to allow improvement in environmental stability and stable prevention of occurrence of hot offset.

Here, the epoxy equivalent means a mass of a resin containing 1 equivalent of an epoxy group.

The epoxy equivalent of the crystalline epoxy resin can be measured by a method in accordance with JIS K 7236.

An additional resin may be used as a binder resin together with the amorphous plant-derived resin having a carboxyl group and the crystalline epoxy resin.

The additional resin is not particularly limited as long as it is a thermoplastic resin, and specific examples thereof include polymers using styrenes, acrylic monomers, methacrylic monomers, ethylenically unsaturated acid monomers, vinyl nitryls, vinyl ethers and/or vinyl ketones.

Examples of the styrenes include styrene, p-chlorostyrene and α-methylstyrene.

Examples of the acrylic monomers include methyl acrylate, ethyl acrylate, n-propyl acrylate, lauryl acrylate and 2-ethylhexyl acrylate.

Examples of the methacrylic monomers include methyl methacrylate, ethyl methacrylate, n-propyl methacrylate, lauryl methacrylate and 2-ethylhexyl methacrylate.

Examples of the ethylenically unsaturated acid monomers include acrylic acid, methacrylic acid and sodium styrenesulfonate.

Examples of the vinyl nitryls include acrylonitrile and methacrylonitrile.

Examples of the vinyl ethers include vinyl methyl ether and vinyl isobutyl ether.

Examples of the vinyl ketones include vinyl methyl ketone, vinyl ethyl ketone and vinyl isopropenyl ketone.

Further examples of the additional resin include homopolymers composed of monomers such as olefines including ethylene, propylene and butadiene; copolymers composed of a combination of two or more kinds of these monomers, and mixtures of these homopolymers and/or copolymers; non-vinyl condensation resins such as epoxy resins, polyester resins, polyurethane resins, polyamide resins, cellulosic resins and polyether resins; mixtures of these resins and vinyl resins; and graft polymers obtained by polymerizing vinyl monomers in the co-presence of these resins.

(3) Colorant

As the colorant, organic colorant or inorganic colorant, colorants of various kinds and various colors may be used, and examples thereof include dyes and pigments. Out of them, pigments are preferably used. Since pigments are excellent in light resistance and color forming properties compared with dyes, use of the pigments allows toner to have excellent light resistance and color forming properties. Specific examples of the colorant include colorants for yellow toner, colorants for magenta toner, colorants for cyan toner and colorants for black toner as described below. Hereinafter, "Color Index" will be abbreviated as "C. I."

Examples of the colorants for yellow toner include organic pigments such as C.I. pigment yellow 1, C.I. pigment yellow 5, C.I. pigment yellow 12, C.I. pigment yellow 15, C.I. pigment yellow 17, C.I. pigment yellow 74, C.I. pigment yellow 93, C.I. pigment yellow 180 and C.I. pigment yellow 185; inorganic pigments such as yellow oxide and ocher; nitro dyes such as C. I. acid yellow 1; and oil-soluble dyes such as C. I. solvent yellow 2, C. I. solvent yellow 6, C. I. solvent yellow 14, C. I. solvent yellow 15, C. I. solvent yellow 19 and C.I. solvent yellow 21, which are categorized in accordance with the Color Index.

Examples of the colorants for magenta toner include C. I. pigment red 49, C. I. pigment red 57, C. I. pigment red 81, C. I. pigment red 122, C. I. solvent red 19, C. I. solvent red 49, C. I. solvent red 52, C. I. basic red 10 and C. I. disperse red 15, which are categorized in accordance with the Color Index.

Examples of the colorants for cyan toner include C. I. pigment blue 15, C. I. pigment blue 16, C. I. solvent blue 55, C. I. solvent blue 70, C. I. direct blue 25 and C. I. direct blue 86, which are categorized in accordance with the Color Index, and KET Blue 111.

Examples of violet pigments include manganese violet, fast violet B and methyl violet lake.

Examples of blue pigments include Prussian blue, cobalt blue, alkali blue lake, Victoria blue lake, copper phthalocyanine blue, metal-free phthalocyanine blue, phthalocyanine blue-partial chlorination product, fast sky blue and indanthrene blue BC.

Examples of green pigments include chrome green, chromium oxide, pigment green B, malachite green lake and final yellow green G.

Examples of the colorants for black toner include carbon blacks such as channel black, roller black, disk black, gas furnace black, oil furnace black, thermal black and acetylene black. An appropriate carbon black may be selected from these various carbon blacks according to design characteristics of the toner desired to be obtained.

Other than these pigments, vermilion pigments and the like may be used. These colorants may be used independently or in combination of two or more kinds thereof. In addition, colorants in the same color system may be used in combination of two or more kinds thereof. Alternatively, colorants in different color systems may be used in combination of one or more kinds in one color system and one or more kinds in the other color system.

The colorant is preferably used as a masterbatch. The colorant masterbatch can be produced by kneading a molten material of a synthetic resin and a colorant, for example. For the synthetic resin, the same resin as a resin constituting a main component of the binder resin for the toner or a resin having good compatibility with a resin constituting a main component of the binder resin for the toner may be used. The ratio between the synthetic resin and the colorant to be used is not particularly limited, and the colorant is preferably used in a range of 30 parts by weight to 100 parts by weight with respect to 100 parts by weight of the synthetic resin. When used, the masterbatch is granulated so as to have a particle diameter of approximately 2 mm to 3 mm, for example.

In the case of a black colorant such as a carbon black, the concentration of the colorant in the toner is preferably in a range of 5% by weight to 12% by weight, and more preferably in a range of 6% by weight to 8% by weight.

Further, in the case of a color image, the concentration of the colorant in the toner is preferably in a range of 3% by weight to 8% by weight, and more preferably in a range of 4% by weight to 6% by weight. When a masterbatch is used, it is preferable to adjust the amount of the masterbatch to use so that content of the colorant in the toner of the present invention is in the above-mentioned ranges. When the content of the colorant is in the above-mentioned ranges, a filler effect due to addition of the colorant can be suppressed and a toner having high coloring power can be obtained. In this case, in addition, a satisfactory image having a sufficient image density, high color forming properties and excellent image quality can be formed.

The content of the colorant of more than 20 parts by weight may lead to increase in elasticity and reduction in fixing ability of the toner due to the filler effect of the colorant.

(4) Other Toner Additives

As needed, other toner additives such as magnetic powder, a release agent and a charge controlling agent may be added to the toner of this embodiment.

Examples of the magnetic powder include magnetite, γ-hematite and various ferrites.

Examples of the release agent include polyolefin waxes such as waxes of low molecular weight polypropylene, polyethylene, oxidized polypropylene and oxidized polyethylene. Use of these release agents allows improvement in the fixing ability of the toner.

The addition amount of the release agent is preferably 1 part by weight to 10 parts by weight with respect to 100 parts by weight of the binder resin.

The charge controlling agent can be categorized into two kinds, that is, charge controlling agents for toner having negative triboelectric chargeability and charge controlling agents for toner having positive triboelectric chargeability.

Examples of the charge controlling agents for toner having negative triboelectric chargeability include surface active agents such as chromium azo complex dyes; iron azo complex dyes; cobalt azo complex dyes; chromium, zinc, aluminum and boron complexes of salicylic acid and salicylic acid derivatives; salicylate compounds; chromium, zinc, aluminum and boron complexes of naphthol acid and naphthol acid derivatives; naphtholate compounds; chromium, zinc, aluminum and boron complexes of benzilic acid and benzilic acid derivatives; benzilate compounds; long-chain alkyl carbonate; and long-chain alkyl sulfonate.

Examples of the charge controlling agents for toner having positive triboelectric chargeability include nigrosine dyes, nigrosine dye derivatives, triphenyl methane derivatives, and derivatives of quaternary ammonium salts, quaternary phosphonium salts, quaternary pyridinium salts, guanidine salts and amidine salts.

The addition amount of the charge controlling agent is preferably 0.01 parts by weight to 5 parts by weight with respect to 100 parts by weight of the binder resin.

(5) External Additive

An external additive may be externally added to the toner of this embodiment for the purpose of, for example, adjustment of the fluidity, prevention of filming on an image carrier and improvement in cleanability of residual toner on the surface of the image carrier.

Examples of the external additive include inorganic oxides such as silica, alumina, titania, zirconia, tin oxide and zinc oxide; homopolymer and copolymer resin microparticles of compounds such as acrylic acid esters, methacrylate esters and styrene; high fatty acids such as fluororesin microparticles, silicone resin microparticles and stearic acid, and metal salts of the high fatty acids; carbon black; graphite fluoride; silicon carbide; and boron nitride.

These external additives are preferably surface-treated with a silicone resin, a silane coupling agent, or the like.

The addition amount of the external additive is preferably 0.5 parts by weight to 5 parts by weight with respect to 100 parts by weight of the binder resin.

The BET specific surface area of the external additive is preferably 20 $m^2/g$ to 200 $m^2/g$. The BET specific surface area of the external additive of 20 $m^2/g$ to 200 $m^2/g$ can give the toner appropriate fluidity and chargeability.

2. Method for Manufacturing Toner

The method for manufacturing the toner of the present invention comprises a mixing step, a kneading step, a cooling step, a pulverizing step, a classifying step and an externally adding step.

Mixing Step

In the mixing step, an amorphous plant-derived resin having a carboxyl group as a binder resin, a crystalline epoxy resin, a colorant and another toner additive are mixed to obtain a mixture.

Use of the crystalline epoxy resin as a toner material allows the toner to have good low-temperature fixing ability.

The content of the crystalline epoxy resin is preferably 5% to 30% by weight with respect to all the toner materials.

When the content of the crystalline epoxy resin is less than 5% by weight, the fixing temperature may not be sufficiently lowered.

On the other hand, when the content of the crystalline epoxy resin is more than 30% by weight, the storage stability may be reduced. When the content of the crystalline epoxy resin is 5% to 30% by weight, more stable low-temperature fixing ability can be ensured, and the storage stability can be more improved.

The ratio of the content of the crystalline epoxy resin to the content of the amorphous plant-derived resin having a carboxyl group (content of the crystalline epoxy resin/content of the amorphous plant-derived resin having a carboxyl group) is preferably 5% to 40% by weight. The ratio in the above-mentioned range allows achievement of both the low-temperature fixing ability and the storage stability.

The THF (tetrahydrofuran) insoluble matter of the mixture is preferably 5% to 30%.

When the THF insoluble matter is more than 30%, the dispersibility of the pigment and the wax is reduced.

For mixing, a commonly known mixer can be used, and examples thereof include mixing equipments of a Henschel type such as HENSCHEL MIXER (trade name, product by Mitsui Mining Co., Ltd.), SUPER MIXER (trade name, product by KAWATA MFG Co., Ltd.), MECHANOMILL (trade name, product by OKADA SEIKO CO., LTD.); ANGMILL (trade name, product by Hosokawa Micron Corporation); HYBRIDAZATION SYSTEM (trade name, product by Nara Machinery Co., Ltd.); COSMOSYSTEM (trade name, product by Kawasaki Heavy Industries, Ltd.); and the like.

Kneading Step

In the kneading step, the mixture is melted and kneaded by using a twin-screw kneader and a cross-linking reaction is caused between the carboxyl group of the amorphous plant-derived resin and the epoxy group of the crystalline epoxy resin under kneading of the mixture. Thus, a kneaded product is obtained.

In the present invention, the cross-linked resin of the amorphous plant-derived resin having a carboxyl group and the crystalline epoxy resin can be finely dispersed in the toner by producing cross-linking reaction between the carboxyl group of the amorphous plant-derived resin and the epoxy group of the crystalline epoxy resin under shearing and kneading with the twin-screw kneader rather than melting and kneading the resin obtained through a cross-linking reaction previously produced between the carboxyl group of the amorphous plant-derived resin and the glycidyl group of the crystalline epoxy resin.

When the dispersibility of the crystalline epoxy resin in the toner is poor, the storage stability of the toner at high temperature is poor. In the toner produced by the method of the present invention, meanwhile, the dispersibility of the crystalline epoxy resin is good and the storage stability at high temperature is therefore good.

In addition, since the cross-linking reaction between the amorphous plant-derived resin having a carboxyl group and the crystalline epoxy resin results in formation of a gel component, the toner produced by the method of the present invention has high viscosity particularly at high temperature and improved heat resistance. As a result, the fixing temperature of the upper limit is raised to allow suppression of hot offset.

Further, in the kneading step, the amorphous plant-derived resin having a carboxyl group and the crystalline epoxy resin can be cross-linked in consideration of change in heat characteristics between the mixture before the kneading step and the kneaded product after the kneading step.

Specifically, the amorphous plant-derived resin having a carboxyl group and the crystalline epoxy resin are cross-linked to the extent that the peak area of a heat absorption peak corresponding to the melting temperature of the crystalline epoxy resin in the kneaded product after the kneading step in a differential scanning calorimetry (DSC) curve measured by using a DSC decreases to 10% or more to 50% or less of the peak area of a heat absorption peak corresponding to the melting temperature of the crystalline epoxy resin in the mixture before the kneading step in the DSC curve.

The extent of the decrease in the heat absorption peak area in the DSC curve can be adjusted by the kneading temperature, which is a temperature at which the mixture is kneaded, and the concentration of the functional group to be involved in the cross-linking reaction in the binder resin.

The kneading temperature for kneading the mixture is preferably 130° C. or more. When the mixture is kneaded at a temperature of 130° C. or more, it is possible to obtain a toner in which the cross-linked structure between the carboxyl group of the amorphous plant-derived resin and the glycidyl group of the crystalline epoxy resin is sufficiently formed.

The THF insoluble matter of the kneaded product is preferably 10% to 40%.

The THF insoluble matter of the kneaded product of 10% to 40% allows the toner to have good low-temperature fixing ability and wide fixing range.

Further, the THF insoluble matter of the kneaded product is preferably 1% to 10% more than the THF insoluble matter of the mixture.

As described above, a twin-screw kneader is used as the kneader. Use of the twin-screw kneader allows the cross-linking reaction between the amorphous plant-derived resin having a carboxyl group and the crystalline epoxy resin to be carried out while uniformly dispersing the resins. Accordingly, it is possible to obtain a toner in which a cross-linked structure is sufficiently formed between the carboxyl group of the amorphous plant-derived resin and the epoxy group of the crystalline epoxy resin.

In addition, when the twin-screw kneader is used, the temperature of the toner materials is easy to increase by the action of shear by kneading, and the cross-linking reaction between the amorphous plant-derived resin having a carboxyl group and the crystalline epoxy resin is easy to proceed.

Cooling Step

In the cooling step, the kneaded product obtained by the melting and kneading is cooled and solidified.

Pulverizing Step

In the pulverizing step, the cooled and solidified product is pulverized with a pulverizer. In the classifying step, particle size control is performed on the pulverized product. Thus, a toner having no external additive is obtained.

Examples of the pulverizer include a jet type pulverizer that performs pulverization by using a supersonic jet stream and an impact type pulverizer that performs pulverization by introducing the solidified product into space formed between a rotator (a rotor) that rotates at high speed and a stator (liner).

Classifying Step

For the classifying step, a commonly known classifier can be used which can remove overpulverized toner base particles by classification using centrifugal force and by classification using wind force, and examples thereof include a rotating type pneumatic classifier (rotary pneumatic classifier) and the like.

Externally Adding Step

In the externally adding step, a toner is obtained by mixing the toner having no external additive and the above-mentioned external additive. It should be noted that a toner to which no external additive is added can be used as the toner.

Next, examples and comparative examples of the toner of the present invention will be described.

Example 1

Preparation of Amorphous Binder Resin

To a container equipped with a stirring apparatus and a heating apparatus, 80.0 parts by weight (2000 g) of a polyester resin (glass transition temperature (Tg): 60° C., softening temperature (T1/2): 125° C., weight average molecular weight: 72500, Mw/Mn=15.2, acid value: 3, THF insoluble matter: 5%) and 20.0 parts by weight (500 g) of a polylactic resin (trade name: TERRAMAC TE-2000C, product by Unitika, Ltd., melting temperature (Tm): 170° C.) were put in, melted at a temperature raised up to 220° C. under stirring, and stirred under heating to obtain a binder resin B (glass transition temperature (Tg): 55° C., softening temperature (T1/2): 110° C., peak top molecular weight: 10500, Mw/Mn=5.1, acid value: 5, THF insoluble matter: 4%) (2250 g).

[Mixing Step]

Toner materials including 65 parts by weight (3250 g) of the amorphous plant-derived resin having a carboxyl group prepared as described above, 20 parts by weight (1000 g) of a crystalline epoxy resin (trade name: YSLV-115XY, product by Tohto Kasei Co., Ltd., melting temperature (Tm): 115° C.), 10 parts by weight (500 g) of a masterbatch of a pigment for cyan toner (C. I. pigment blue 15) (pigment concentration: 4%) as a colorant that was preliminarily kneaded and dispersed at a concentration of 40% by weight in the amorphous plant-derived resin having a carboxyl group, 3 parts by weight (150 g) of a polyethylene wax (trade name: PW-600, product by Baker Petrolite Corporation, melting temperature (Tm): 87° C.) as a release agent and 2 parts by weight (100 g) of a charge controlling agent (trade name: COPY CHARGE N4P VP 2481, product by Clariant Japan K.K.) were mixed for 10 minutes by using a Henschel mixer (trade name: FM20C, product by Mitsui Mining Co., Ltd.) to obtain a material mixture (4950 g). The THF insoluble matter of this mixture was 15.8%.

[Melting and Kneading Step]

The obtained material mixture was melted and kneaded by using a twin-screw kneader PCM-30, product by Ikegai Corporation under the conditions of set temperature of cylinder (kneading temperature): 80° C. to 140° C. (maximum temperature: 140° C.), rotation frequency: 250 rpm and rate of feed: 5 kg/hour to prepare a melted and kneaded product. The THF insoluble matter of the kneaded product was 21.8%.

[Pulverizing and Classifying Step]

The melted and kneaded product obtained in the melting and kneading step was cooled to room temperature, solidified, and then coarsely pulverized with a cutter mill (trade name: VM-16, product by ORIENT Co, Ltd.) Subsequently, the coarsely pulverized product was finely pulverized with a counter jet mill (trade name: AFG, product by Hosokawa Micron Corporation), and then the pulverized product obtained was classified by using a rotary classifier (trade name: TSP SEPARATOR, product by Hosokawa Micron Corporation) to obtain a toner having no external additive.

[Externally Adding Step]

Subsequently, 1.2 parts by weight (6 g) of hydrophobic fine silica powder (BET specific surface area: 140 $m^2/g$) surface-treated with a silane coupling agent and dimethyl silicone oil, 0.8 parts by weight (4 g) of hydrophobic fine silica powder (BET specific surface area: 30 $m^2/g$) surface-treated with a silane coupling agent and 0.5 parts by weight (2.5 g) of titanium oxide (BET specific surface area: 130 $m^2/g$) were added to 100 parts by weight (500 g) of particles of the obtained toner having no external additive and mixed by using a Henschel mixer (trade name: FM MIXER, product by Mitsui Mining Co., Ltd.) to produce a toner of Example 1 (500 g).

The volumetric average particle diameter of the obtained toner was 7.0 μm, and the coefficient of variation (CV value) of the toner was 25%.

Example 2

A toner of Example 2 having negative triboelectric chargeability was obtained in the same manner as in Example 1 except that the crystalline epoxy resin was changed (trade name: YSLV-95XY, product by Tohto Kasei Co., Ltd., melting temperature (Tm): 93° C.) in the mixing step.

Example 3

A toner of Example 3 having negative triboelectric chargeability was obtained in the same manner as in Example 1 except that the crystalline epoxy resin was changed (trade name: YSLV-125XY, product by Tohto Kasei Co., Ltd., melting temperature (Tm): 125° C.) in the mixing step.

Example 4

A toner of Example 4 having negative triboelectric chargeability was obtained in the same manner as in Example 1 except that the maximum temperature of the set temperature of cylinder was changed as shown in Table 1 in the melting and kneading step.

Comparative Example 1

A toner of Comparative Example 1 having negative triboelectric chargeability was obtained in the same manner as in Example 1 except that the crystalline epoxy resin was changed (trade name: YSLV-85XY, product by Tohto Kasei Co., Ltd., melting temperature (Tm): 85° C.) in the mixing step.

Comparative Example 2

A toner of Comparative Example 2 having negative triboelectric chargeability was obtained in the same manner as in Example 1 except that the crystalline epoxy resin was changed (trade name: YSLV-135XY, product by Tohto Kasei Co., Ltd., melting temperature (Tm): 133° C.) in the mixing step.

Comparative Example 3

A toner of Comparative Example 3 having negative triboelectric chargeability was obtained in the same manner as in Example 1 except that the maximum temperature of the set temperature of cylinder was changed as shown in Table 1 in the melting and kneading step.

<<Measuring Method for Physical Properties>>

Measurement for physical properties in Examples and Comparative Examples was performed as described below.

[Glass Transition Temperature (Tg) of Binder Resin]

By use of a differential scanning calorimetry (trade name: DIAMOND DSC, product by PerkinElmer Co., Ltd.), 0.01 g of a sample was heated at a rate of temperature rise of 10° C. per minute (10° C./minute) to measure a DSC curve in accordance with Japanese Industrial Standard (JIS) K7121-1987.

A temperature at an intersection point between a straight line obtained by extending a base line at a low-temperature side of the heat absorption peak corresponding to the glass transition in the obtained DSC curve toward a high-temperature side and a tangent line to a curve at a low-temperature side of the peak drawn at a point allowing the gradient to be the maximum was determined as a glass transition temperature (Tg).

[Softening Temperature (T1/2)]

By use of a flow characteristic evaluation apparatus (trade name: FLOW TESTER CFT-500C, product by Shimazu Corporation), 0.1 g of a sample was inserted in a cylinder and heated at a rate of temperature rise of 6° C. per minute (6° C./minute) under a load of 10 kgf/cm$^2$ (0.980665 MPa) to extrude the sample from a die, and a temperature at which half of the sample flowed out of the die was determined as a softening temperature. The die used here was 1 mm in aperture and 1 mm in length.

[Weight Average Molecular Weight (Mw) and Molecular Weight Distribution Index (Mw/Mn)]

By use of a GPC apparatus (trade name: HLC-8220GPC, product by Tosoh Corporation), a sample solution, which is a tetrahydrofuran (hereinafter, abbreviated as "THF") solution of 0.25% by weight of a sample, was determined for a molecular weight distribution curve under conditions of a temperature of 40° C. and an injection amount of the sample solution of 200 μL. A weight average molecular weight Mw and a number average molecular weight Mn were determined from the obtained molecular weight distribution curve, and the ratio of the weight average molecular weight Mw to the number average molecular weight Mn was determined as the molecular weight distribution index (Mw/Mn: hereinafter, merely referred to as "Mw/Mn"). Here, a molecular weight calibration curve was prepared by using a standard polystyrene.

[Acid Value]

Measurement for the acid value was performed by a neutralization titration method as described below. In 50 mL of THF, 5 g of a sample was dissolved and several drops of an ethanol solution of phenolphthalein was added as an indicator to carry out titration with 0.1 mol/L of a potassium hydroxide (KOH) aqueous solution. With a point when the color of the sample solution turned from colorless to violet as an end point, an acid value (mgKOH/g) was calculated from the amount of the potassium hydroxide aqueous solution needed until reaching the end point and the weight of the sample subjected to the titration.

[THF Insoluble Matter of Binder Resin]

A sample in an amount of 1 g was put in an extraction thimble and placed on a Soxhlet extractor, and then heated to reflux with 100 mL of THF as a solvent for 6 hours to extract a THF soluble component in the sample by THF. The solvent was removed from an extract containing the extracted THF soluble component, and then the THF soluble component was dried at 100° C. for 24 hours to weigh a weight X (g) of the obtained THF soluble component.

A proportion P (% by weight) of the THF insoluble matter, which is a THF indissoluble component in the binder resin, was calculated from the determined weight X (g) of the THF soluble component and the weight of the sample used for the measurement (1 g) according to the following formula (1):

$$P(\%\text{ by weight})=\{1\text{ (g)}-X\text{ (g)}\}/1\text{ (g)}\times 100 \quad (1)$$

Hereinafter, the proportion P will be referred to as THF insoluble matter.

[Melting Temperature (Tm)]

By use of a differential scanning calorimetry (trade name: DIAMOND DSC, product by PerkinElmer Co., Ltd.) and in accordance with Japanese Industrial Standard (JIS) K7121-1987, the temperature of 0.01 g of a sample was raised from 20° C. to 200° C. at a rate of 10° C. per minute, and subsequently reduced from 200° C. to 20° C. at a rate of 50° C. per minute, and then again raised from 20° C. to 200° C. at a rate of 10° C. per minute to obtain a DSC curve. For a peak of melting heat in the DSC curve, a temperature at the top of the peak was determined as a melting temperature (Tm).

[Particle Size Distribution (Volumetric Average Particle Diameter (D50) and Coefficient of Variation (CV Value) of Toner]]

To 50 ml of an electrolytic solution (trade name: ISOTON-II, product by Beckman Coulter, Inc.), 20 mg of a sample and 1 ml of alkyl ether sulfuric acid ester sodium (dispersant, product by Kishida Chemical Co., Ltd.) were added and subjected to an ultrasonic dispersion treatment at an ultrasonic frequency of 20 kHz for 3 minutes by using an ultrasonic disperser (trade name: UH-50, product by SMT Co., Ltd.) to obtain a sample for measurement.

By use of a particle size distribution measuring apparatus (trade name: MULTISIZER 3, product by Beckman Coulter, Inc.), the sample for measurement was measured for the particle diameter of sample particles under conditions of an aperture diameter of 20 μm and a particle count of 50000. A volumetric particle size distribution of the sample particles was determined from the measurement result obtained, and a volumetric average particle diameter D50 (μm) was calculated from the volumetric particle size distribution.

In addition, a standard deviation in the volumetric particle size distribution was determined to calculate a coefficient of variation (CV value, %) according to the following formula (2):

$$\text{CV value }(\%)=[\text{standard deviation in volumetric particle size distribution/volumetric average particle diameter }(\mu\text{m})]\times 100 \quad (2)$$

The volumetric average particle diameter D50 (μm) means a particle diameter when a cumulative volume from a larger particle diameter side in a cumulative volume distribution reaches 50%.

[THF Insoluble Matter of Mixture and Kneaded Product]

By use of an ultrasonic disperser, 10 g of the mixture and the kneaded product were each mixed with 100 ml of tetrahydrofuran (THF) and dissolved for 30 minutes. Thereafter, 3.0 μm of the mixed solution was filtered through a membrane filter, and then residue on the filter was washed with 50 ml of normal hexane. The membrane filter was dried at 50° C. for 1 hour, and the THF insoluble matter was calculated according to the following formula (3):

$$\text{THF insoluble matter (wt }\%)=(\text{weight of residue on membrane filter/weight of mixture and kneaded product initially prepared})\times 100 \quad (3)$$

<<Evaluation Method>>

The toners prepared in Examples and Comparative Examples were evaluated as follows.

[Evaluation for Low-Temperature Fixing Ability]

A ferrite core carrier having a volumetric average particle diameter of 45 μm as a carrier and each toner of Examples and Comparative Examples were mixed by using a V type mixer (trade name: V-5, product by TOKUJU Co., LTD.) for 20 minutes so that the coverage of the toner on the carrier would be 60% to produce a two-component developer.

With the obtained two-component developer, a sample image including a 20-by-50 mm rectangle-shaped solid image part was adjusted so that the adhesion amount of the toner in an unfixed state in the solid image part to a recording paper (trade name: PPC PAPER SF-4AM3, product by Sharp Corporation) as a recording medium would be 0.5 mg/cm$^2$ to produce an unfixed image on the recording paper by using a machine obtained by modifying a color multifunction printer (trade name: MX-2700, product by Sharp Corporation). A non-offset region of the obtained unfixed image was fixed at a predetermined temperature by using an external fixing device produced using a fixing unit of the color multifunction printer, and presence or absence of offset on the surface of the paper was evaluated by visual observation. Here, the processing speed of the fixing device was 124 mm/second, and the test paper used was A4-size 52 g/m$^2$ paper. Under this condition, a temperature range in which neither low-temperature offset nor hot offset occurred was defined as a non-offset temperature range to be used as an index of the fixing ability.

In this evaluation method, the fixing temperature of the lower limit was evaluated as follows:

G (good): 140° C. or less;

NB (not bad): 145° C. to 155° C.; and

B (bad): 160° C. or more, and G and NB were determined as practically usable levels.

[Evaluation for Hot Offset Resistance (Temperature Width Allowing Fixation)]

The hot offset resistance was evaluated by a temperature width allowing fixation. The temperature width allowing fixation is a temperature width in which neither low-temperature offset nor hot offset occurred and determined according to the following formula (4):

$$\text{Temperature width allowing fixation (° C.)} = \text{fixing temperature of upper limit (° C.)} - \text{fixing temperature of lower limit (° C.)} \quad (4)$$

Here, the fixing temperature of the upper limit was a temperature of the upper limit at which hot offset did not occur when the unfixed image was fixed at fixing temperatures increased from 130° C. in increments of 5° C. by using the external fixing device.

In the above-described evaluation method for the fixing ability, the temperature width allowing fixation was evaluated as follows:

G: 60° C. or more;

NB: 45° C. to 55° C.; and

G: 40° C. or less, and G and NB were determined as practically usable levels.

[Evaluation for Storage Stability]

Evaluation for the storage stability was performed using a mesh up rate. That is, 100 g of each toner of Examples and Comparative Examples was put in a polyethylene container, sealed, and allowed to stand in a thermostat bath at 50° C. for 48 hours. The toner after having been allowed to stand was vibrated with a vibrating sieve machine having a 200 mesh net at 60 Hz for 1 minute, and the toner left on the mesh net was weighed. A percentage of the toner left on the mesh net was determined as the mesh up rate and calculated according to the following formula (5):

$$\text{Mesh up rate (\%)} = [100\ \text{(g)} / \text{weight (g) of toner left on mesh net}] \times 100 \quad (5)$$

The lower mesh up rate indicates the better storage stability at high temperature.

The criteria for evaluation for the storage stability are as follows.

G: good (The mesh up rate is less than 1.0%.)

NB: Not bad (The mesh up rate is 1.0% or more and less than 3.0%.)

B: bad (The mesh up rate is 3.0% or more).

Here, G and NB were determined as practically usable levels.

[Overall Judgment]

Overall judgment was made based on the results of the three evaluation items, that is, the fixing temperature of the lower limit, the temperature width allowing fixation and the storage stability.

The criteria for the overall judgment are as follows.

VG: very good (The results of all the three evaluation items were G.)

G: good (The results of the three evaluation items include at least one NB but no B.)

B: bad (The results of the three evaluation items include at least one B.)

Table 1 shows the results of the fixing temperature of the lower limit, the temperature width allowing fixation, the storage stability and the overall judgment.

TABLE 1

| | Composition (part by weight) | | | | | Crystalline resin | Amorphous resin | Kneading | THF insoluble matter (wt %) | | Fixing temp. | Temp. width | Storage | Overall |
|---|---|---|---|---|---|---|---|---|---|---|---|---|---|---|
| | Amorphous | Crystalline | MB | Release agent | CCA | Tm (° C.) | Tm (° C.) | Temp. (° C.) | Before kneading | After kneading | of lower limit (° C.) | allowing fixation (° C.) | stability % | judgment |
| Example 1 | 65 | 20 | 10 | 3 | 2 | 115 | 115 | 140 | 15.8 | 21.8 | G: 135 | G: 65 | G: 0.7 | VG |
| Example 2 | 65 | 20 | 10 | 3 | 2 | 93 | 115 | 140 | 15.8 | 21.3 | G: 130 | NB: 55 | NB: 2.9 | G |
| Example 3 | 65 | 20 | 10 | 3 | 2 | 125 | 115 | 140 | 15.7 | 22.9 | NB: 150 | NB: 50 | G: 0.5 | G |
| Example 4 | 65 | 20 | 10 | 3 | 2 | 115 | 115 | 135 | 17.1 | 19.2 | G: 135 | NB: 55 | G: 0.8 | G |
| Comparative Example 1 | 65 | 20 | 10 | 3 | 2 | 85 | 115 | 140 | 15.7 | 21.1 | G: 130 | NB: 55 | B: 3.5 | B |
| Comparative Example 2 | 65 | 20 | 10 | 3 | 2 | 133 | 115 | 140 | 15.8 | 23.1 | B: 160 | NB: 45 | G: 0.5 | B |
| Comparative Example 3 | 65 | 20 | 10 | 3 | 2 | 115 | 115 | 125 | 17.3 | 18.6 | G: 135 | B: 40 | G: 0.8 | B |

Comparison between the toners of Examples and the toners of Comparative Examples based on the results shown in Table 1 reveals the followings. As for the toner of Comparative Example 1, the storage stability was reduced and the temperature width allowing fixation was slightly narrower, because a crystalline epoxy resin having a lower melting temperature was used. As for the toner of Comparative Example 2, the fixing temperature of the lower limit rose and the temperature width allowing fixation was narrower, because a crystalline epoxy resin having a higher melting temperature was used. As for the toner of Comparative Example 3, the temperature width allowing fixation was narrower, because the kneading temperature was lower.

Thus, it is indicated that the results of the toners of Examples are better than the results of the toners of Comparative Examples with respect to the three evaluation items.

It is also indicated that the toner of Example 1 in which the melting temperature of the crystalline epoxy resin and the kneading temperature are optimal has better low-temperature fixing ability, wider temperature width allowing fixation and better storage stability.

The present invention provides a toner that is effective for prevention of global warming, because a plant-derived resin using plant-derived resources, which are carbon-neutral, is used as a binder resin. Besides, the toner can be excellent in hot offset resistance, while maintaining the low-temperature fixing ability as containing the crystalline epoxy resin component and the cross-linked resin component. At the same time, the present invention provides a method for manufacturing the toner. Further, the present invention provides, when an epoxy resin having a melting temperature of 90° C. to 130° C. is used as the crystalline epoxy resin, a toner having high fixing strength and a method for manufacturing the toner.

What is claimed is:

1. A toner comprising:

a component consisting of a thermoplastic resin containing an amorphous plant-derived resin having a carboxyl group;

a component consisting of a crystalline epoxy resin having a glycidyl group;

a component consisting of a cross-linked resin generated through a reaction between the carboxyl group of the plant-derived resin and the glycidyl group of the crystalline epoxy resin; and a colorant.

2. The toner according to claim 1, wherein the thermoplastic resin contains 20% by weight or more of the plant-derived resin.

3. The toner according to claim 1, wherein the plant-derived resin is polylactic acid, polymethylene terephthalate, polybutylene succinate, polyhydroxybutyrate or polyhydroxyalkanoate resin, or polyester resins composed of succinic acid or itaconic acid and 1,3-propanediol or 1,4-butanediol.

4. The toner according to claim 1, wherein the plant-derived resin is an amorphous polyester resin.

5. The toner according to claim 1, wherein the plant-derived resin is an amorphous polyester resin having an acid value ranging from 10 KOHmg/g to 30 KOHmg/g.

6. The toner according to claim 1, wherein the plant-derived resin is an amorphous polyester resin having a weight average molecular weight (Mw) ranging from 5000 to 100000.

7. The toner according to claim 1, wherein the plant-derived resin is an amorphous polyester resin having a glass transition temperature (Tg) ranging from 55° C. to 70° C.

8. The toner according to claim 1, wherein the plant-derived resin is an amorphous polyester resin having a 1/2 flow softening temperature (Tm) ranging from 100° C. to 140° C.

9. The toner according to claim 1, wherein the crystalline epoxy resin is bisphenol-type, thioether-type, hydroquinone-type or biphenyl-type epoxy resin.

10. The toner according to claim 1, wherein the crystalline epoxy resin has a melting temperature of 90° C. to 130° C.

11. The toner according to claim 1, wherein the crystalline epoxy resin is contained in a ratio ranging from 5% to 30% by weight with respect to all the toner materials, and contained in a ratio ranging from 5% to 40% with respect to a content of the amorphous plant-derived resin.

12. The toner according to claim 1, wherein the cross-linked resin contains from 10% to 50% of the crystalline epoxy resin.

13. A method for manufacturing a toner, comprising:

melting and kneading a component consisting of a thermoplastic resin containing an amorphous plant-derived resin having a carboxyl group and a component consisting of a crystalline epoxy resin having a glycidyl group at a temperature of 130° C. or more to manufacture a toner comprising:

a component consisting of the plant-derived resin;

a component consisting of the crystalline epoxy resin;

a component consisting of a cross-linked resin generated through a reaction between the carboxyl group of the plant-derived resin and the glycidyl group of the crystalline epoxy resin; and a colorant.

14. A toner comprising:

a component consisting of a thermoplastic non-vinyl resin containing an amorphous plant-derived non-vinyl resin having a carboxyl group;

a component consisting of a crystalline non-vinyl epoxy resin having a glycidyl group;

a component consisting of a cross-linked non-vinyl resin generated through a reaction between the carboxyl group of the plant-derived non-vinyl resin and the glycidyl group of the crystalline non-vinyl epoxy resin; and a colorant.

15. The toner according to claim 14, wherein the thermoplastic resin contains 20% by weight or more of the plant-derived non-vinyl resin.

16. The toner according to claim 14, wherein the plant-derived non-vinyl resin is polylactic acid, polymethylene terephthalate, polybutylene succinate, polyhydroxybutyrate or polyhydroxyalkanoate resin, or polyester resins composed of succinic acid or itaconic acid and 1,3-propanediol or 1,4-butanediol.

17. The toner according to claim 14, wherein the plant-derived non-vinyl resin is an amorphous polyester resin.

18. The toner according to claim 14, wherein the plant-derived non-vinyl resin is an amorphous polyester resin having an acid value ranging from 10 KOHmg/g to 30 KOHmg/g.

19. The toner according to claim 14, wherein the plant-derived non-vinyl resin is an amorphous polyester resin having a weight average molecular weight (Mw) ranging from 5000 to 100000.

20. The toner according to claim 14, wherein the plant-derived non-vinyl resin is an amorphous polyester resin having a glass transition temperature (Tg) ranging from 55° C. to 70° C.

21. The toner according to claim 14, wherein the plant-derived non-vinyl resin is an amorphous polyester resin having a 1/2 flow softening temperature (Tm) ranging from 100° C. to 140° C.

22. The toner according to claim 14, wherein the crystalline non-vinyl epoxy resin is bisphenol-type, thioether-type, hydroquinone-type or biphenyl-type epoxy resin.

23. The toner according to claim 14, wherein the crystalline non-vinyl epoxy resin has a melting temperature of 90° C. to 130° C.

24. The toner according to claim 14, wherein the crystalline non-vinyl epoxy resin is contained in a ratio ranging from 5% to 30% by weight with respect to all the toner materials, and contained in a ratio ranging from 5% to 40% with respect to a content of the amorphous plant-derived resin.

25. The toner according to claim 14, wherein the cross-linked non-vinyl resin contains from 10% to 50% of the crystalline epoxy resin.

26. A method for manufacturing a toner, comprising:

melting and kneading a component consisting of a thermoplastic resin containing an amorphous plant-derived non-vinyl resin having a carboxyl group and a component consisting of a crystalline non-vinyl epoxy resin having a glycidyl group at a temperature of 130° C. or more to manufacture a toner comprising:

a component consisting of the plant-derived non-vinyl resin;

a component consisting of the crystalline non-vinyl epoxy resin;

a component consisting of a cross-linked non-vinyl resin generated through reaction between the carboxyl group of the plant derived non-vinyl resin and the glycidyl group of the crystalline non-vinyl epoxy resin; and a colorant.

* * * * *